US005249709A

United States Patent [19]

Duckworth et al.

[11] Patent Number: 5,249,709

[45] Date of Patent: Oct. 5, 1993

[54] CARTRIDGE SYSTEM FOR DISPENSING PREDETERMINED RATIOS OF SEMI-LIQUID MATERIALS

[75] Inventors: George J. Duckworth, Guilford; Richard W. Clemens, Somers, both of Conn.

[73] Assignee: Plas-Pak Industries, Inc., Norwich, Conn.

[21] Appl. No.: 879,832

[22] Filed: May 6, 1992

Related U.S. Application Data

[63] Continuation-in-part of Ser. No. 422,235, Oct. 16, 1989, abandoned.

[51] Int. Cl.[5] ..... B67D 5/42

[52] U.S. Cl. ..... 222/137; 222/145; 222/327; 222/386

[58] Field of Search ..... 222/135, 136, 137, 145, 222/386, 387, 326, 327, 388-391; 403/381, 361, 334; 220/4 B, 4 E, 234; 206/221

[56] References Cited

U.S. PATENT DOCUMENTS

| | | | |
|---|---|---|---|
| 2,941,699 | 6/1960 | Schmidt et al. | 222/327 |
| 3,066,836 | 12/1962 | Trumbull | 222/327 |
| 3,166,221 | 4/1962 | Nielsen | 222/137 |
| 3,250,443 | 5/1966 | Abbott, Jr. | 222/327 |
| 3,311,265 | 3/1967 | Creighton, Jr. et al. | 222/137 |
| 3,323,682 | 6/1967 | Creighton, Jr. et al. | 222/94 |
| 3,366,265 | 1/1968 | Hesselbarth | 220/234 |
| 3,378,175 | 4/1968 | Krieps | 222/327 |
| 3,390,814 | 7/1968 | Creighton, Jr. et al. | 222/137 |
| 3,828,980 | 8/1974 | Creighton et al. | 222/137 |
| 4,027,810 | 6/1977 | van Manen | 222/327 |
| 4,169,547 | 10/1979 | Newell | 222/386 |
| 4,217,995 | 8/1980 | Robillard | 222/327 |
| 4,260,077 | 4/1981 | Schroeder | 222/137 |
| 4,402,431 | 9/1983 | Wiegner et al. | 222/327 X |
| 4,471,888 | 9/1984 | Herb et al. | 222/137 |
| 4,538,920 | 9/1985 | Drake | 366/177 |
| 4,560,352 | 12/1985 | Neümeister et al. | 222/390 |
| 4,684,044 | 8/1987 | Foster | 222/386 |
| 4,767,026 | 8/1988 | Keller et al. | 222/137 |
| 4,830,229 | 5/1989 | Ball | 222/209 |
| 4,836,423 | 6/1989 | Hayes et al. | 222/145 |
| 4,854,485 | 8/1989 | Collins | 222/327 X |
| 4,903,868 | 2/1990 | Ichihara et al. | 222/387 X |
| 4,907,727 | 3/1990 | Ernst et al. | 222/325 X |
| 4,981,241 | 1/1991 | Keller | 222/137 |

FOREIGN PATENT DOCUMENTS

| | | | |
|---|---|---|---|
| 0259599 | 3/1988 | European Pat. Off. | 222/327 |
| 0316102 | 5/1989 | European Pat. Off. | 222/327 |
| 1220388 | 1/1971 | United Kingdom | 222/327 |

OTHER PUBLICATIONS

Albion Catalog pages describing Twin-Cartridge Systems, Albion Engineering Co., Philadelphia, Pa., Jan. 1989.

Sika Catalog pages showing Co-Axial Multicomponent Cartridge.

Anchor-It Catalog pages showing Co-Axial Multicomponent Cartridge.

Dedoes Catalog pages showing Two Part Meter/Mix Gun, J. Dedoes, Grand Rapids, Mich.

TAH Catalog pages showing Motionless Mixers.

Bayer & Otto Catalog pages showing Guns for Two Cartridge Systems, Bayer & Otto, Kleinostheim, Germany.

*Primary Examiner*—Andres Kashnikow
*Assistant Examiner*—A. Pomrening
*Attorney, Agent, or Firm*—John H. Crozier

[57] ABSTRACT

In a preferred embodiment, a system for dispensing semi-liquid materials in predetermined ratios, which system includes two cartridges having the same or selected different diameters, but proportional to the ratio of the materials to be dispensed, the cartridges being rigidly snapped together by interfitting male and female elements. In another aspect of the invention, there is provided a seal for a cartridge for dispensing semi-liquid material which seal includes a resilient wiping lip formed around the outer periphery of the seal which is forced against the inner surface of a cartridge by the flattening of the convex face of the seal. In a further aspect of the invention, there is provided a cartridge for dispensing semi-liquid material which cartridge includes grooves formed in the inner wall thereof extending inwardly a distance from the edge of the filling end thereof so that air may readily be expelled from the cartridge as the seal is inserted after filling of the cartridge.

25 Claims, 4 Drawing Sheets

CARTRIDGE SYSTEM FOR DISPENSING PREDETERMINED RATIOS OF SEMI-LIQUID MATERIALS

CROSS-REFERENCE TO RELATED APPLICATION

This application is a continuation-in-part of copending application Ser. No. 07/422,235, filed Oct. 16, 1989, now abandoned.

BACKGROUND OF THE INVENTION

1. Field of the Invention

The present invention relates to means for dispensing semi-liquid materials generally and, more particularly, to a novel system for dispensing two such materials simultaneously and in a predetermined ratio.

2. Background Art

There are a number of circumstances in which it is desirable to dispense semi-liquid materials in a predetermined ratio. The materials may include reactive, two component adhesives, sealants, coatings, or potting compounds, in which adhesive one material may comprise a resin compound and the other material a catalyst. The chemical families of such materials include epoxies, acrylics, silicones, polyesters, urethanes, polyurethane foams, and hybrid and reactive elastomers and adhesives.

In some cases, particularly in the past, it was necessary to separately dispense one of two materials and then the other and then to mix them. Various devices have been developed to simultaneously dispense the materials in preselected ratios. These devices generally comprise two cylindrical cartridges, or a single cartridge having two cylindrical bores, for insertion in a cartridge gun which typically has two plungers which move together against seals in one end of the cartridges to dispense the materials from nozzles in the other end of the cartridges. The latter type of cartridge has the disadvantage that the manufacturer must inventory a supply of cartridges for each ratio of materials. Some of the former types provide for the use of different size cartridges, but the cartridges thereof are poorly joined together.

In all known such cartridges, the seals thereof do not provide thorough wiping of the bore of the cartridges and, therefore, the seals may freeze in place, due to hardening of the materials that leak past them, or hazardous materials may be released into the surrounding environment from leakage around the seals. In one prior seal for such cartridges, the seal had a cylindrical body portion, with a convex face which contacted the material in a cartridge. An outwardly facing pointed lip was formed near the end of a portion of the cylindrical shell which inclined outwardly from the shell at an angle of about 6 degrees, forming a trough between the inclined portion the the convex face. As a plunger pressed against the concave inner surface of the face, it tended to flatten the face and thereby forced the inclined portion against the inner surface of the cylinder. While that arrangement was satisfactory for low-pressure applications, the seal tended to leak in high-pressure applications.

Also, in known such cartridges, there is no satisfactory provision for venting air from the cartridges as the seals are inserted therein after filing of the cartridges.

Accordingly, it is a principal object of the present invention to provide a cartridge system for the dispensing of semi-liquid materials in predetermined ratios which system includes two cartridges of selected diameters rigidly fastened together.

Another object of the invention is to provide a seal for a cartridge for dispensing semi-liquid material which seal includes means for ensuring thorough wiping and sealing of the inner surface of the cartridge.

An additional object of the invention is to provide a cartridge for dispensing semi-liquid material which cartridge includes means for venting air from the cartridge as a seal is inserted into the cartridge after filling of the cartridge.

A further object of the invention is to provide a system for dispensing semi-liquid materials in predetermined ratios which system is economically manufactured and has easily changed ratios.

It is another object of the invention to provide means for securely attaching together the two cartridges.

Other objects of the present invention, as well as particular features and advantages thereof, will be elucidated in, or apparent from, the following description and the accompanying drawing figures.

SUMMARY OF THE INVENTION

The present invention accomplishes the above objects, among others, and substantially overcomes the disadvantages of conventional devices by providing, in a preferred embodiment, a system for dispensing semi-liquid materials in predetermined ratios, which system includes two cartridges having the same or selected different diameters, but proportional to the ratio of the materials to be dispensed, the cartridges being rigidly snapped together by means of interfitting male and female elements. In another aspect of the invention, there is provided a seal for a cartridge for dispensing semi-liquid material which seal includes a resilient wiping lip formed around the outer periphery of the seal which is forced against the inner surface of a cartridge by the flattening of a convex end face of the seal when in use. In a further aspect of the invention, there is provided a cartridge for dispensing semi-liquid material which cartridge includes grooves formed in the inner wall thereof extending inwardly a distance from the edge of the filling end thereof so that air may readily be expelled from the cartridge as the seal is inserted after filling of the cartridge.

DESCRIPTION OF THE PREFERRED EMBODIMENTS

Figure 1:
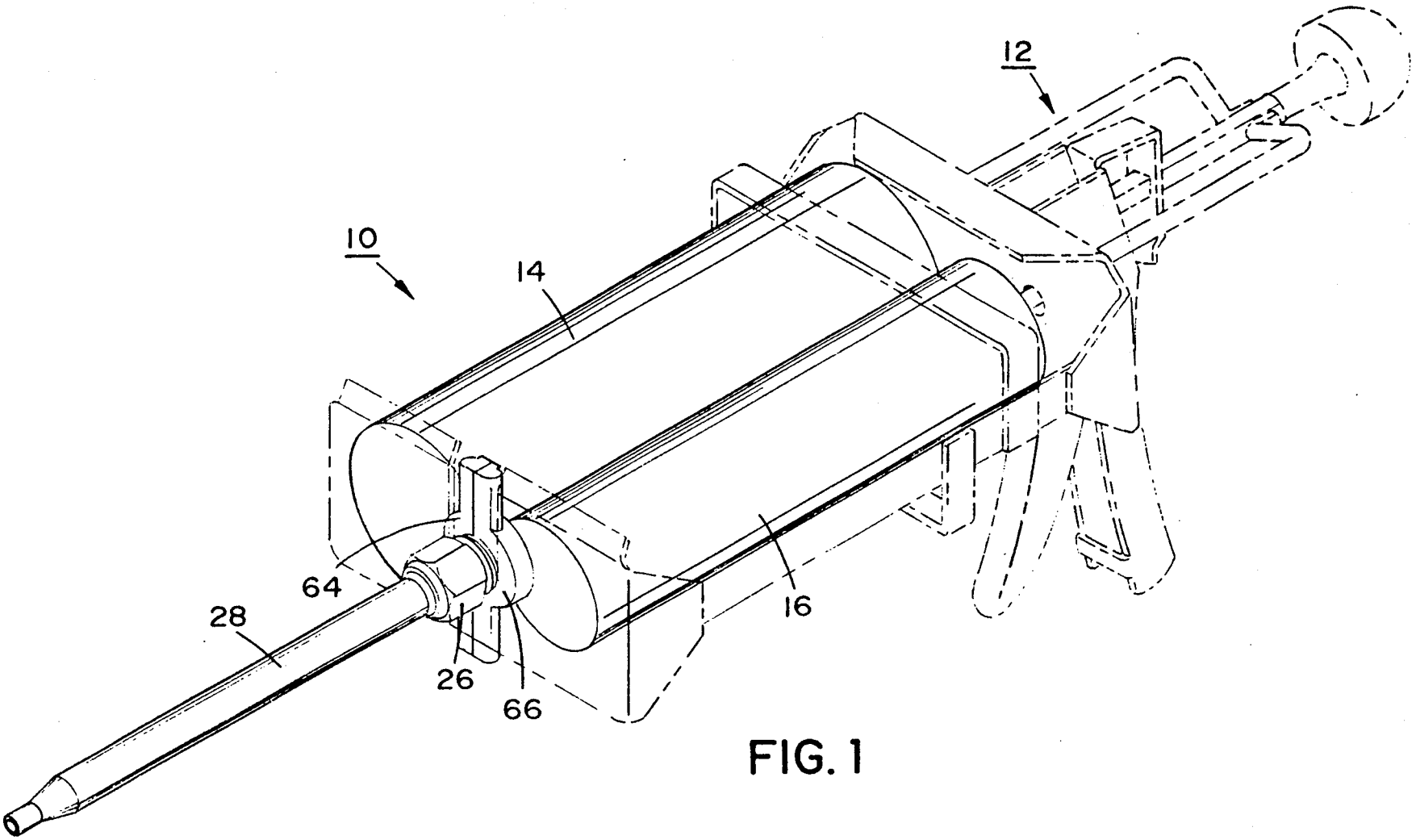
FIG. 1 is a perspective view of the system of the present invention fitted with a motionless mixer and inserted in a cartridge gun.

Referring now to the Drawing, in which the same elements have consistent identifying numerals throughout the various figures, reference should first be made to FIG. 1 which shows the system of the present invention, generally indicated by the reference numeral 10, mounted in a cartridge gun, generally indicated by the reference numeral 12. System 10 is shown as being fitted with a motionless mixer 28, the function of which will be discussed below.

While system 10 is shown mounted in a manual, trigger-activated cartridge gun 12, the system may be used as well with conventional pneumatic or screw-advance cartridge guns or it may be used as well with various types of conventional bench-mounted metering systems.

Figure 2:
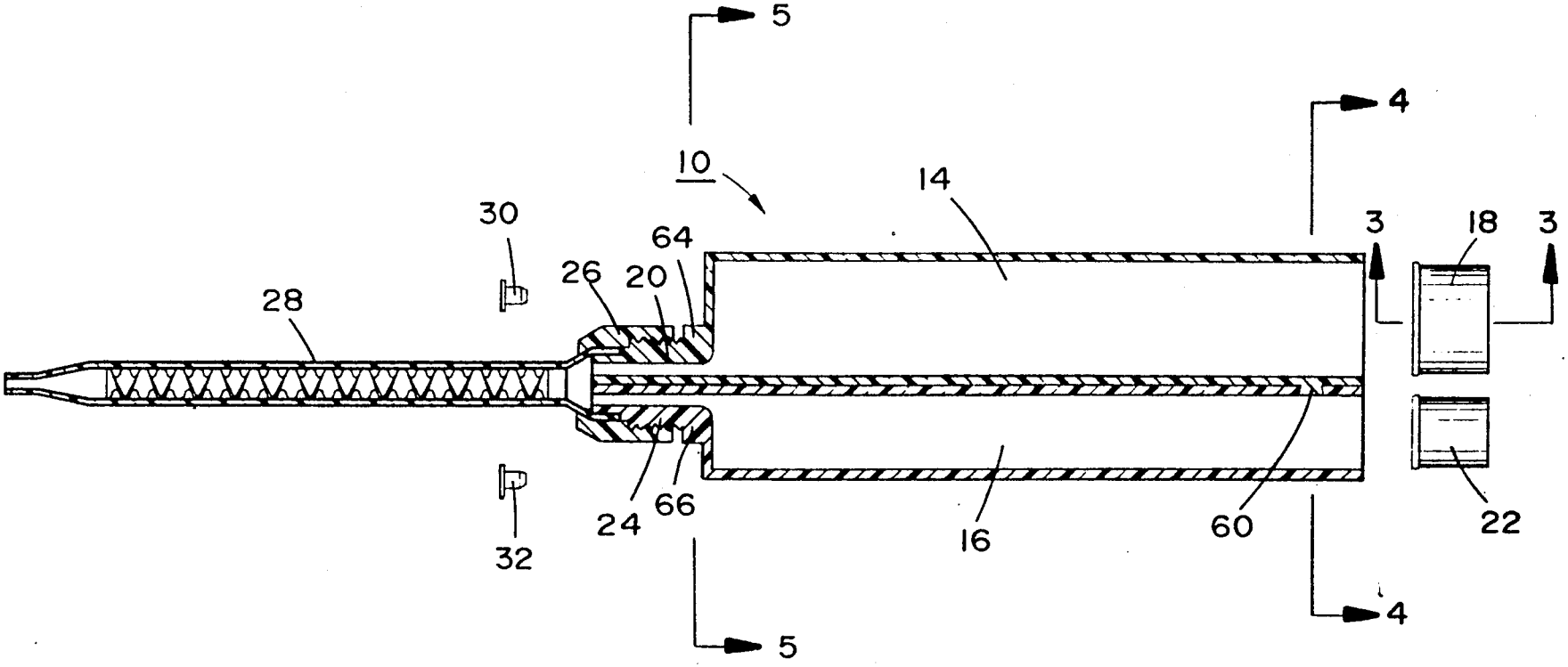
FIG. 2 is a partially cross-sectional view of the system of FIG. 1.

Referring now also to FIG. 2, system 10 includes cartridges 14 and 16 snap fitted together as will be described in more detail below. It can be seen that the respective diameters of cartridges 14 and 16 have been selected so that the cross-sectional area of cartridge 14 is about twice that of cartridge 16, the result of that selection being that twice as much material will be dispensed from cartridge 14 than will be dispensed from cartridge 16 when system 10 is placed in gun 12 (FIG. 1) having parallel, coacting plungers. It will be understood that any desired ratio of cross-sectional areas may be chosen and that, regardless of the ratio chosen, the function of the various elements of system 10 will be unchanged.

Cartridge 14 includes a seal 18 for insertion in the filling end of the cartridge and, at the dispensing end of the cartridge, there is formed an outlet nozzle 20. Likewise, cartridge 16 includes a seal 22 for insertion in the filling end of the cartridge and an outlet nozzle 24 formed at the dispensing end of the cartridge. It can be seen that outlet nozzles 20 and 24 each form one-half of a threaded structure over which a bonnet 26 may be threadedly advanced to secure motionless mixer 28 to the dispensing ends of cartridges 14 and 16. Motionless mixer 28, when used, provides thorough mixing of the materials dispensed from cartridges 14 and 16 and is preferably disposable. Motionless mixer 28 need not be used with system 10, however, and, when not so used, the materials will be dispensed directly from outlet nozzles 20 and 24 and will require a separate mixing step.

When system 10 is not in use, outlet nozzles 20 and 24 may be sealed, respectively, by means of removable end plugs 30 and 32 inserted thereinto.

Figure 3:
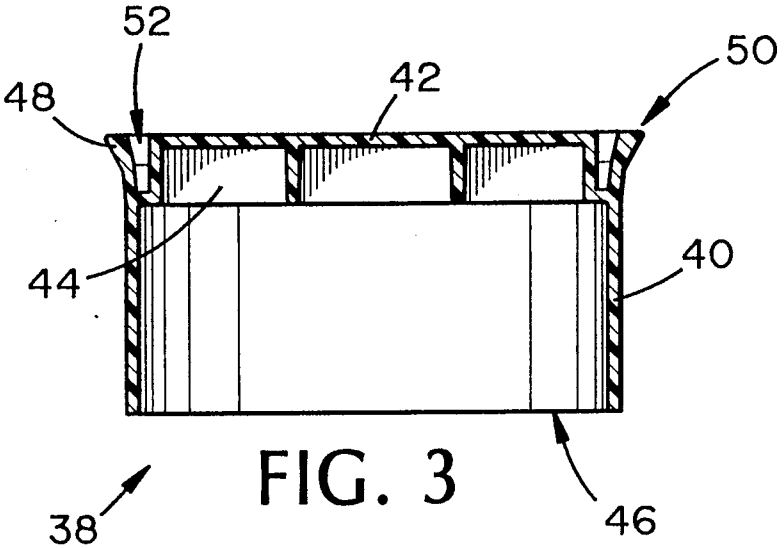
FIG. 3 is a side elevation view, in cross-section, of a seal with a wiping lip, according to the present invention.

FIG. 3 is a side elevation view, in cross-section, of a seal, generally indicated by the reference numeral 38, which may be used in system 10 or may be used in any cartridge. Seal 38 includes a cylindrical shell 40, a flat end portion 42 which bears against the material being dispensed (not shown), a reinforcing structure 44, integral with end portion 42, against which may bear, for example, a piston of a cartridge gun (not shown), and an open end 46 into which the piston may be inserted. It can be seen that the outer surface of cylindrical shell 40 is not of uniform diameter, but the portion thereof adjacent end 42 flares outwardly to form a circumferential resilient lip 48 extending beyond the straight portion of the shell when the lip is in its natural position shown on FIG. 3, with the outer portion of the lip terminating in a pointed annular ridge 50 facing outwardly from the central axis of seal 38. When seal 38 is inserted in a cartridge, such as seal 18 on FIG. 2 inserted in cartridge 14, the lip would be compressed inward with ridge 50 contacting the inner surface of the cartridge and thoroughly wiping the inner surface as material is dispensed from the cartridge. Lip 48 is given resilience, in part, by means of a trough 52 defined in seal 38 between the lip and end portion 42. Thus, material in the tube is substantially prevented from flowing past seal 38 as material is dispensed from the cartridge, by virtue of lip 48 and ridge 50. The contact between ridge 50 and the inner surface of the cartridge in which seal 38 is inserted also aids in preventing solvent in the material from evaporating.

Figure 7:
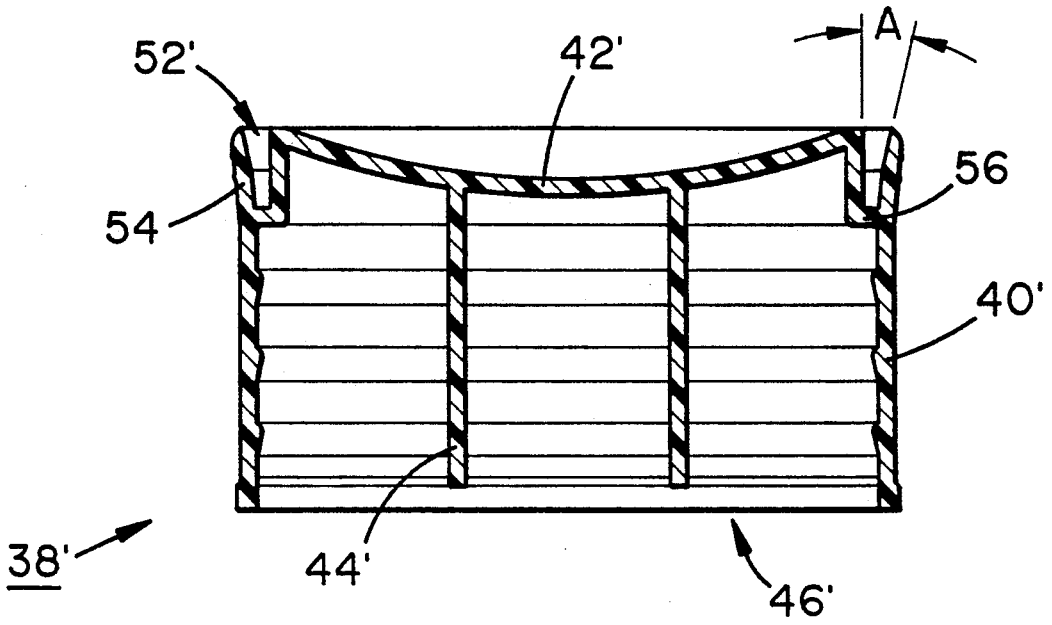
FIG. 7 is an enlarged, side elevation view, in cross-section, of an alternative embodiment of a seal with a wiping lip, according to the present invention.

FIG. 7 is a side elevational view, in cross-section, of a seal, generally indicated by the reference numeral 38', which may be used in system 10 or may be used in any cartridge. Seal 38' includes a cylindrical shell 40', a concave end portion 42' which bears against the material being dispensed (not shown), a reinforcing structure 44', integral with end portion 42', against which may bear, for example, a piston of a cartridge gun (not shown), and an open end 46' into which the piston may be inserted. It can be seen that the outer surface of cylindrical shell 40' is not of uniform diameter, but includes a outwardly inclined flange portion 54 adjacent concave end portion 42'. Concave end portion 42' and inclined flange portion 54 are joined by a common annular section 56 to form a V-shaped trough 52' therebetween. When seal 38' is inserted in a cartridge, such as seal 18 on FIG. 2 inserted in cartridge 14, inclined flange portion 54 would be compressed inward with the distal end of the inclined flange portion contacting the inner surface of the cartridge and thoroughly wiping the inner surface as material is dispensed from the cartridge. Thus, material in the tube is substantially prevented from flowing past seal 38' as material is dispensed from the cartridge, by virtue of the distal end of inclined flange portion 54. The contact between the distal end of inclined flange portion 54 and the inner surface of the cartridge in which seal 38' is inserted also aids in preventing solvent in the material from evaporating.

The angle "A" defined between inclined flange portion 54 and the side of concave end portion 42' is preferably at least about 15 degrees. It has been found that maintaining an angle of at least about 15 degrees prevents leakage at higher pressures.

To further aid in sealing against the inner surface of the cartridge in which seal 38' may be inserted, as a piston of a cartridge gun (not shown) bears against the concave inner side of reinforcing structure 44', the reinforcing structure and concave end portion 42' tend to flatten, rotating the distal end of inclined flange portion 54 around annular section 56 to more tightly seal against the inner surface of the cartridge.

Figure 8:
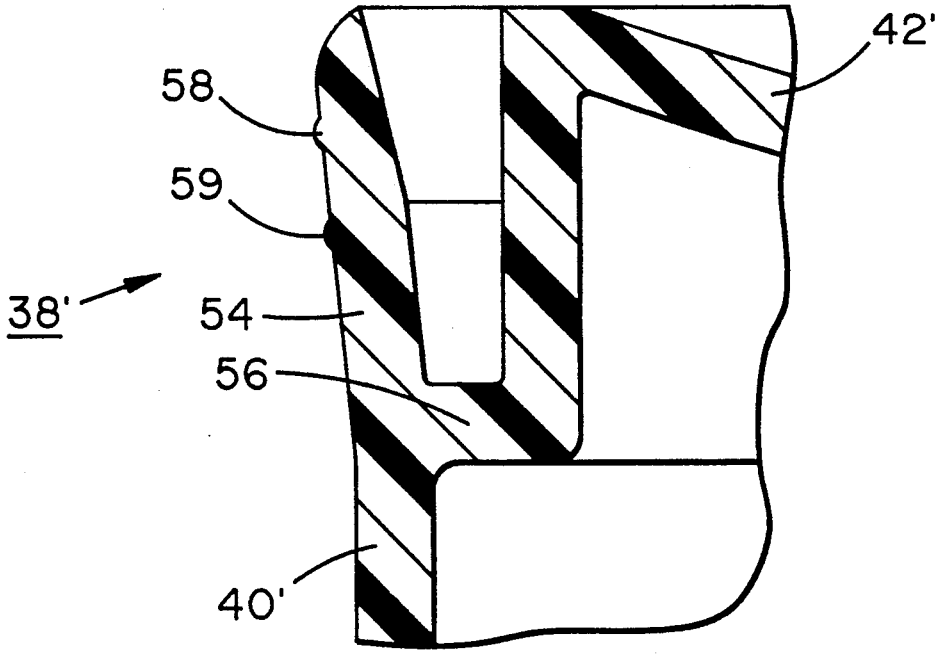
FIG. 8 is a greatly enlarged side elevational view, in cross-section of a detail of the wiping lip of FIG. 7.

FIG. 8 illustrates another feature (not shown on FIG. 7) of seal 38'. Formed around the outer periphery of flange 54 are two annular ridges 58 and 59. In use, annular ridges 58 and 59 provide a line-to-flat contact with the wall of a cartridge. It has been found that this is a more effective sealing action than the flat-to-flat contact which would otherwise result.

Figure 4:
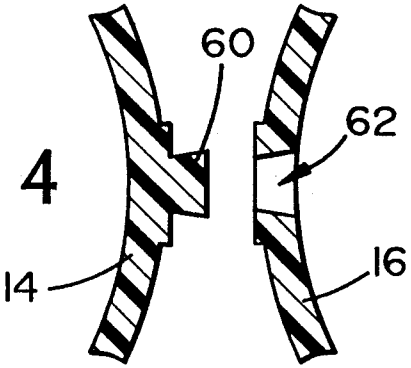
FIG. 4 is a partial front elevation view, in cross-section, showing the means by which the filling ends of the cartridge tubes are snapped together, according to the present invention.

Reference to FIGS. 2 and 4 will illustrate how the filling ends of cartridges 14 and 16 are snapped together. Here, it can be seen that a rectangular male pin 60, having a head portion larger than the base portion, formed on the outer wall of cartridge 14 can fit into a female receptacle 62, having a complementary shape, defined in cartridge 16, by means of temporary deformation of the pin as elements 60 and 62 are joined. It will be understood that the tapers of elements 60 and 62 are shown somewhat exaggerated for clarity.

Figure 5:
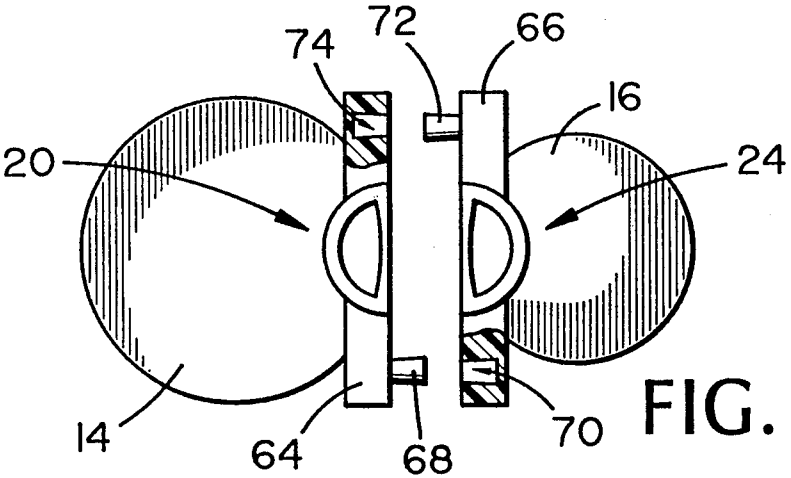
FIG. 5 is a front elevation view, partially in cross-section, showing the means by which the dispensing ends of the cartridge tube are snapped together, according to the present invention.

Reference to FIG. 5 will illustrate how the dispensing ends of cartridges 14 and 16 are snapped together. Here, it can be seen that mating bosses 64 and 66 are formed, respectively, on outlet nozzles 20 and 24. A round male pin 68, having a head portion larger than its base portion, formed on boss 64, can fit grippingly into a complementary female receptacle 70 defined in boss 66. Likewise, a round male pin 72, having a head portion larger than its base portion, formed on boss 66, can fit grippingly into a complementary female receptacle 74 defined in boss 64. Pins 68 and 72 are inserted into receptacles 70 and 74, respectively, by means of temporary deformation of the pins. Again, it will be understood that the tapers of elements 68, 70, 72, and 74 are shown somewhat exaggerated for clarity.

Thus, having three points of attachment between cartridges 14 and 16, with one point of attachment in the plane common to the central axes of the cartridges and two points of attachment perpendicular to and spaced apart from the common plane, secures the cartridges against relative axial movement, relative rotational movement, and relative twisting movement.

The respective elements which allow the snapping together of cartridges according to the present invention have identical dimensions for all sizes of cartridges to permit any selected ratio of sizes thereof to be chosen within the range of cartridges provided. A pair of joined cartridges may also be separated relatively easily, if desired, without damage thereto, and the cartridges may then be joined to other cartridges.

Figure 6:
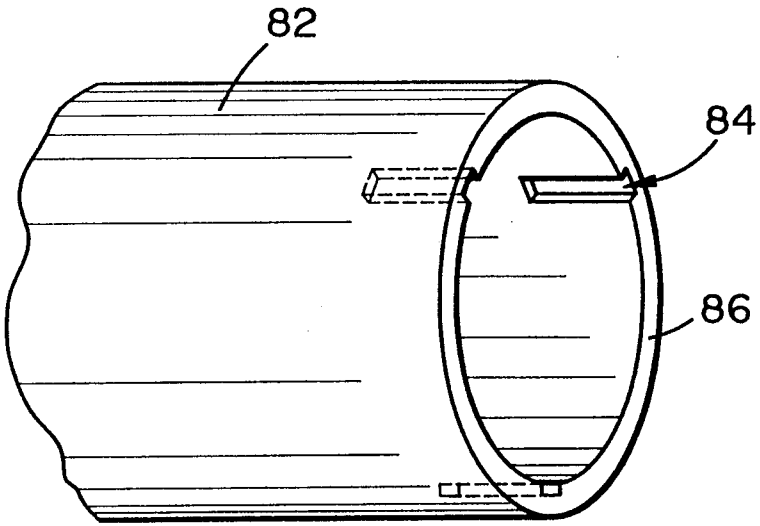
FIG. 6 is a perspective view of the filling end of a cartridge showing venting means, according to the present invention.

FIG. 6 shows the means of venting a cartridge after filling. Here, a cartridge 82, of the type described above, has a plurality of slots, as at 84, defined in the inner surface thereof. Slots 84 extend from the edge 86 of the filling end of cartridge 82 a distance inwardly from the filling end, the distance being approximately equal to the distance a seal (not shown) is to be inserted therein. It will be understood that, after cartridge 82 is filled with semi-liquid material (not shown), the seal would be inserted into the filling end thereof and air would be expelled from the cartridge through slots 84 as the seal is inserted. This arrangement allows the use of a closely fitting seal, such as seal 38 on FIG. 3, and also prevents the trapping of air within a cartridge which would tend to dry out or, in come cases, catalyze the hardening of, the material in the cartridge.

The various elements of system 10 may be conveniently and economically manufactured by injection molding and preferably are manufactured by injection molding of high density polyethylene.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A cartridge system for use in simultaneously dispensing a predetermined ratio of semi-liquid materials, comprising:

(a) two cylindrical cartridges having selected cross-sectional areas in proportion to said predetermined ratio, each said cartridge having a first, open, filling end and a second, closed, dispensing end with an outlet nozzle formed therein;

(b) each said cartridge having a seal slidingly dispose din the bore thereof to cause a semi-liquid material to be dispensed from said outlet nozzle when force is applied to said seal;

(c) attachment means, formed integrally with said cylindrical cartridges, to rigidly snap together said two cartridges;

(d) said attachment means including two pairs of face-to-face opposing mating surfaces oppositely extending outwardly axially from a common central axis of said two cartridges, orthogonal to a plane on which the longitudinal axes of said cartridges lie; and (e) opposing pairs of snap together fittings formed in the distal ends of said mating surfaces to rigidly snap together said two cartridges.

2. A system, as defined in claim 1, wherein said snap together fittings comprise a plurality of male pins and female receptacles disposed in opposing pairs, each said opposing pair comprising one said male pin protruding from one of two mating surfaces of said two cartridges and one said female receptacle defined in the other of said two mating surfaces of said two cartridges, such that, when said surfaces are mated, said male pin is grippingly held within said female receptacle.

3. A system, as defined in claim 2, wherein said male pins have head portions larger than their base portions and said female receptacles have dimensions complementary to the dimensions of said male pins, such that said male pins may be snappingly inserted into said female receptacles by means of temporary deformation of said male pins as said male pins are being inserted into said female receptacles.

4. A system, as defined in claim 1, further comprising at least one additional pair of snap together fittings longitudinally spaced apart along the central axis of said cartridges from said mating surfaces.

5. A system, as defined in claim 1, wherein said mating surfaces extend axially outwardly from said outlet nozzles.

6. A system, as defined in claim 1, wherein each of said seals comprises:

(a) a generally hollow, cylindrical shell portion having an open, first end and a closed, second end having a flat portion orthogonal to the major axis of said cylindrical shell portion, the outside of said flat portion to bear against said semi-liquid material and the inside of said flat portion to be engaged by a piston of a cartridge gun; and (b) said cylindrical shell portion having an outwardly facing lip formed around, and extending beyond, the outer periphery thereof, said lip terminating in a outwardly facing, pointed ridge.

7. A system, as defined in claim 6, wherein said lip is in proximity to said second end of said seal.

8. A system, as defined in claim 7, further comprising an annular trough defined between said lip and said flat portion.

9. A system, as defined in claim 6, further comprising a reinforcing structure formed integrally with said flat portion within said cylindrical portion.

10. A system, as defined in claim 1, further comprising at least one venting channel defined in the inner periphery of each said cartridge, said at least one venting channel extending inwardly from the edge of said filling end.

11. A system, as defined in claim 10, wherein said at least one venting channel extends inwardly a distance approximately equal to the distance said seal would be inserted in said each said cartridge.

12. A seal for axial movement within a cartridge to dispense a semi-liquid material from said cartridge when force is applied to said seal, comprising:

(a) a generally hollow, cylindrical shell portion having an open, first end and a closed, second end having a flat portion orthogonal to the major axis of said cylindrical shell portion, the outside of said flat portion to bear against said semi-liquid material and the inside of said flat portion to be engaged by a piston of a cartridge gun; and (b) said cylindrical shell portion having an outwardly facing lip formed around, and extending beyond, the outer periphery thereof, said lip terminating in a outwardly facing, pointed ridge.

13. A seal, as defined in claim 12, wherein said lip is disposed in proximity to said second end of said seal.

14. A seal, as defined in claim 12, further comprising an annular trough defined between said lip and said flat portion.

15. A seal, as defined in claim 12, further comprising a reinforcing structure formed integrally with said flat portion within said cylindrical portion.

16. A cartridge system for use in simultaneously dispensing a predetermined ratio of semi-liquid materials, comprising:

(a) two cylindrical cartridges having selected cross-sectional areas in proportion to said predetermined ratio, each said cartridge having a first, open, filling end and a second, closed, dispensing end with an outlet nozzle formed therein;

(b) each said cartridge having a seal slidingly dispose din the bore thereof to cause a semi-liquid material to be dispensed from said outlet nozzle when force is applied to said seal;

(c) attachment means comprising a plurality of male pins and female receptacles disposed in opposing pairs, each said opposing pair comprising one said male pin protruding from one of two mating surfaces of said two cartridges and one said female receptacle defined in the other of said two mating surfaces of said two cartridges, such that, when said surfaces are mated, said male pin is grippingly held within said female receptacle; and (d) two of said opposing pairs are disposed in proximity to said second ends of said cartridges.

17. A system, as defined in claim 16, further comprising:

(a) said mating surfaces include surfaces of bosses formed at said second ends; and (b) said two of said opposing pairs connect said bosses, such that said two pairs of said opposing pairs lie spaced apart substantially on a plane orthogonal to a plane on which the longitudinal axes of said cartridges lie.

18. A cartridge system for use in simultaneously dispensing a predetermined ratio of semi-liquid materials, comprising:

(a) two cylindrical cartridges having selected cross-sectional areas in proportion to said predetermined ratio, each said cartridge having a first, open, filling end and a second, closed, dispensing end with an outlet nozzle formed therein;

(b) attachment means, formed integrally with said cylindrical cartridges, to rigidly snap together said two cartridges; and (c) each said cartridge having a seal slidingly disposed in the bore thereof to cause a semi-liquid material to be dispensed from said outlet nozzle when force is applied to said seal;

each said seal comprising:

(d) a generally hollow, cylindrical shell portion having an open, first end and a closed, second end having a concave portion orthogonal to the major axis of said cylindrical shell portion, the outside of said concave portion to bear against said semi-liquid material and the inside of said concave portion to be engaged by a piston of a cartridge gun;

(e) said cylindrical shell portion having an inclined flange portion extending beyond the outer periphery thereof so as to form a trough between said inclined flange portion and said concave end portion, the distal end of said inclined flange portion to bear against the inner surface of a said cartridge, said inclined flange portion being inclined outwardly form said cylindrical shell portion at an angle of at least about 15 degrees with respect to said major axis of said cylindrical shell portion; and (f) said concave end portion to tend to flatten as said piston bears against the inside of said concave portion to cause the distal end of said inclined flange portion to more tightly bear against said inner surface.

19. A system, as defined in claim 18, wherein said distal end of said inclined flange portion is in proximity to said concave end portion of said seal.

20. A system, as defined in claim 18, wherein said trough defined between said distal end of said inclined flange portion and said concave end portion is V-shaped.

21. A system, as defined in claim 18, further comprising a reinforcing structure formed integrally with said concave end portion within said cylindrical portion.

22. A seal for axial movement within a cartridge to dispense a semi-liquid material from said cartridge when force is applied to said seal, comprising:

(a) a generally hollow, cylindrical shell portion having an open, first end and a closed, second end having a concave portion orthogonal to the major axis of said cylindrical shell portion, the outside of said concave portion to bear against said semi-liquid material and the inside of said concave portion to be engaged by a piston of a cartridge gun;

(b) said cylindrical shell portion having an inclined flange portion extending beyond the outer periphery thereof so as to form a trough between said inclined flange portion and said concave end portion, the distal end of said inclined flange portion to bear against the inner surface of a said cartridge, said inclined flange portion being inclined outwardly from said cylindrical shell portion at an angle of at least about 15 degrees with respect to said major axis of said cylindrical shell portion.

(c) said concave end portion to tend to flatten as said piston bears against the inside of said concave portion to cause the distal end of said inclined flange portion to more tightly bear against said inner surface; and (d) at least one annular ridge formed around the outer periphery of said flange portion so as to provide a line-to-flat contact with the inner surface of a said cartridge when said seal is inserted in said a said cartridge.

23. A system, as defined in claim 22, wherein said distal end of said inclined flange portion is in proximity to said concave end portion of said seal.

24. A system, as defined in claim 22, wherein said trough defined between said distal end of said inclined flange portion and said concave end portion is V-shaped.

25. A system, as defined in claim 22, further comprising a reinforcing structure formed integrally with said concave end portion within said cylindrical portion.

* * * * *